US009315297B2

(12) United States Patent
Jönsson et al.

(10) Patent No.: US 9,315,297 B2
(45) Date of Patent: Apr. 19, 2016

(54) RESEALABLE OPENING DEVICE AND PACKAGE COMPRISING SUCH AN OPENING DEVICE

(75) Inventors: Bengt Jönsson, Vallåkra (SE); Peter Marbe, Lomma (SE)

(73) Assignee: ECOLEAN AB, Helsingborg (SE)

( * ) Notice: Subject to any disclaimer, the term of this patent is extended or adjusted under 35 U.S.C. 154(b) by 67 days.

(21) Appl. No.: 13/884,892

(22) PCT Filed: Nov. 9, 2011

(86) PCT No.: PCT/EP2011/069749

§ 371 (c)(1),
(2), (4) Date: Sep. 11, 2013

(87) PCT Pub. No.: WO2012/062806

PCT Pub. Date: May 18, 2012

(65) Prior Publication Data

US 2014/0003744 A1 Jan. 2, 2014

(30) Foreign Application Priority Data

Nov. 11, 2010 (SE) ..... 1051188
Jan. 26, 2011 (SE) ..... 1150053

(51) Int. Cl.
*B65D 33/16* (2006.01)
*B65D 33/25* (2006.01)
(Continued)

(52) U.S. Cl.
CPC . *B65D 33/16* (2013.01); *B31B 1/00* (2013.01); *B65D 33/1675* (2013.01);
(Continued)

(58) Field of Classification Search
CPC ..... B65D 75/00; B65D 75/56; B65D 75/58; B65D 77/12; B65D 33/25; B65D 33/16; B65D 33/2533; B65D 33/1691; B65D 33/20; B65D 33/26; B65D 33/30; B65D 31/005; B65D 33/1675; B65D 33/1683; B65D 75/008; B65D 75/5805; B65D 75/5816; B65D 2575/586; A45C 13/06; A01M 31/00; B31B 1/00; B31B 2219/6007; B31B 2219/603; B31B 2219/9012
USPC ..... 383/78, 81–86, 88–89
See application file for complete search history.

(56) References Cited

U.S. PATENT DOCUMENTS 432,308 A * 7/1890 Guilbert ..... 383/88
2,369,716 A * 2/1945 Coghill ..... 493/189
(Continued)

FOREIGN PATENT DOCUMENTS

CH 701361 A1 12/2010
DE 4213397 A1 10/1993
(Continued)

*Primary Examiner* — J. Gregory Pickett
*Assistant Examiner* — Peter Helvey
(74) *Attorney, Agent, or Firm* — Volpe and Koenig, P.C.

(57) ABSTRACT

An opening device for a flexible package having an opening portion defined by two side walls and a width, the opening device intended to be disposed in the opening portion of the package adjacent to an opening, formed upon initial opening of the package, for opening and closing thereof. The opening device comprises a thin-walled first body with a contact surface and a first application surface opposite thereto for allowing application of the first body in the opening portion to a first of the two side walls. The first body is maneuverable, by folding about a first folding axis, between a basic position and a sealing position. In the sealing position, the contact surface has sub portions directly facing each other. A locking member is designed for releasable locking of the body in the sealing position.

25 Claims, 12 Drawing Sheets

(51) Int. Cl.

| | |
|---|---|
| ***B65D 75/00*** | (2006.01) |
| ***B65D 75/56*** | (2006.01) |
| ***B65D 75/58*** | (2006.01) |
| ***B65D 77/12*** | (2006.01) |
| ***B31B 1/00*** | (2006.01) |

(52) U.S. Cl.

CPC ..... *B65D 33/1683* (2013.01); *B65D 33/1691* (2013.01); *B65D 33/25* (2013.01); *B65D 75/008* (2013.01); *B65D 75/56* (2013.01); *B65D 75/5805* (2013.01); *B65D 75/5816* (2013.01); *B65D 77/12* (2013.01); *B31B 2219/603* (2013.01); *B31B 2219/6007* (2013.01); *B31B 2219/9012* (2013.01); *B65D 2575/586* (2013.01)

(56) References Cited

U.S. PATENT DOCUMENTS

| | | | | | |
|---|---|---|---|---|---|
| 2,620,944 | A | * | 12/1952 | Stahl | 222/107 |
| 2,843,309 | A | * | 7/1958 | Wheeler | 383/5 |
| 3,208,640 | A | * | 9/1965 | Paulson | 222/94 |
| 3,397,835 | A | * | 8/1968 | Henning | 383/208 |
| 3,727,829 | A | | 4/1973 | Huni | |
| 3,815,810 | A | * | 6/1974 | Wellman | 383/204 |
| 4,027,819 | A | * | 6/1977 | Herrera-Gutierrez | 383/204 |
| 5,692,837 | A | | 12/1997 | Beer | |
| 6,007,246 | A | * | 12/1999 | Kinigakis et al. | 383/204 |
| 6,047,883 | A | | 4/2000 | Calvert et al. | |
| 6,082,897 | A | | 7/2000 | Galomb | |
| 6,168,312 | B1 | | 1/2001 | Hausslein | |
| 6,296,388 | B1 | | 10/2001 | Galomb | |
| 6,773,163 | B2 | * | 8/2004 | Ichikawa et al. | 383/204 |
| 7,331,716 | B2 | * | 2/2008 | Nakano et al. | 383/203 |
| 8,641,279 | B2 | * | 2/2014 | Ichikawa et al. | 383/65 |
| 2004/0032995 | A1 | * | 2/2004 | Galomb | 383/63 |
| 2004/0208399 | A1 | | 10/2004 | Linneweil | |
| 2005/0031228 | A1 | | 2/2005 | Galomb et al. | |
| 2005/0141787 | A1 | * | 6/2005 | Breil | 383/61.2 |
| 2008/0044115 | A1 | * | 2/2008 | Ichikawa et al. | 383/204 |
| 2008/0138459 | A1 | * | 6/2008 | Gaikwad et al. | 425/404 |

FOREIGN PATENT DOCUMENTS

| | | | |
|---|---|---|---|
| DE | 29902988 | U1 | 5/1999 |
| DE | 102006029119 | A1 | 7/2007 |
| DE | 102006005740 | A1 | 8/2007 |
| EP | 1048580 | A2 | 11/2000 |
| WO | 2004092022 | A2 | 10/2004 |
| WO | 2010047645 | A1 | 4/2010 |

* cited by examiner

RESEALABLE OPENING DEVICE AND PACKAGE COMPRISING SUCH AN OPENING DEVICE

TECHNICAL FIELD

The present invention relates to a resealable opening device for a flexible package and to a package comprising such an opening device.

BACKGROUND OF THE INVENTION

There are a large number of different goods which are packed in flexible packages produced from a film material.

The packages may house particulate goods, such as crisps, peanuts or coffee beans, and in this case often have a so-called pillow shape.

Alternatively, the packages may house liquid goods, such as milk, water or wine, and are here normally of the so-called stand-up pouch type, also referred to as collapsible-type packages. Packages of the stand-up pouch type may, of course, also be used for particulate goods.

Packages or containers of this flexible type are normally opened by the removal of an end tab or corner portion. Alternatively, they can be opened by a user pulling apart the side walls of the package in order thereby to break an upper transverse seal of the package.

Common to these flexible packages is that there is often a need to be able to reseal the package once it has been opened. By resealing the package, the risk of accidental spillage of the content of the package is reduced, whilst the resealing often has a positive effect on the shelf life of the content.

This resealing can be realized with the aid of clips, screw caps, rubber bands, tapes, etc. It has nevertheless proved difficult to provide an opening device which is cheap, reliable, user-friendly and, moreover, relatively easy to apply to the package in connection with the filling thereof. Opening devices for flexible packages are known, for example, from U.S. Pat. Nos. 3,815,810, 6,296,388 and WO2004/092022.

U.S. Pat. No. 3,815,810 discloses an opening device in the form of a thin-walled body which is applied to a side wall of the package. For resealing of the package, an end section comprising an opening is folded, and the end section is locked in the folded state by means of tabs of the body which are folded up over the said end section.

U.S. Pat. No. 6,296,388 discloses a foldable thin-walled body which is intended for application inside an opening of the package.

WO2004/092022 discloses various types of opening devices of the zip-lock type, which are stamped in place in the package adjacent to its opening.

It can thus be seen that there is a need for an improved resealable opening device for flexible packages.

SUMMARY OF THE INVENTION

In view of the above, it is an object of the present invention to provide an improved resealable opening device for a flexible package.

It is also an object of the invention to provide a flexible package comprising a resealable opening device of this kind.

According to the present invention, a resealable opening device having the distinguishing features defined in claim 1 and a package having the distinguishing features defined in claim 21 are thus provided. Embodiments emerge from the sub-claims dependent on the respective main claims.

More precisely, according to the present invention, an opening device for a flexible package having an opening portion which is defined by two side walls and has a width is provided, which opening device is intended to be disposed in the opening portion of the package adjacent to an opening, formed upon initial opening of the package, for opening and closing thereof, which opening device comprises a thin-walled first body with a contact surface and a first application surface opposite thereto for allowing application of the said first body in the opening portion to a first of the said two side walls, and a locking member. The first body is manoeuvrable, by folding about a first folding axis, between a basic position and a sealing position, in which sealing position the said contact surface has sub portions directly facing each other. Said sub portions adjoin each other along a boundary portion which is designed to extend along substantially the full width of the opening portion, and the said locking member is designed for releasable locking of the body in the said sealing position. The locking member is disposed in at least one of the sub portions of the contact surface and is designed to act between the said sub portions in order to achieve said releasable locking.

An improved, resealable opening device for a flexible package is hereby provided. The opening device comprises a foldable first body and a locking member which allows locking of the first body in the folded position, i.e. the sealing position, and is thus relatively easy and cheap to produce. Since the body of the opening device is thin-walled and is also foldable about the first folding axis, the body can be made substantially flat and is hence relatively easy to apply in the opening portion of a package. The inventive opening device also allows reliable resealing of a flexible package. The opening device is here arranged in the opening portion of the flexible package by placing the application surface of the body against one of the two side walls of the package which define the opening portion. The opening device can be applied to the package with the aid of an adhesive or by a heat treatment process or the like. By manoeuvring the first body of the opening device from its basic position into its sealing position, i.e. by folding the first body about the first folding axis, it becomes possible to fold an end section of the opening portion over the said first folding axis, whereby the package is resealed. By suitably adapting the length of the first body in relation to the width of the opening portion, it is possible to achieve resealing with a high level of reliability. More precisely, it is assured that the sub portions adjoin each other along said boundary portion, which is designed to extend along substantially the full width of the opening portion. Preferably, it is assured that the length of the first body somewhat exceeds the width of the opening portion, whereby a substantially liquid-tight resealing can be achieved.

According to one embodiment, a first hinge joint having an extent which coincides with said first folding axis may be configured in the said first body. It is hereby ensured that the folding about the first folding axis during manoeuvring of the first body from the basic position into its sealing position is well-defined. The first hinge joint can here have a v-shaped or w-shaped cross section. In particular, the use of a w-shaped cross section on the first hinge joint can make it possible to achieve such tight resealing that a package housing a liquid content can be turned up and down without leakage after it is resealed.

According to another embodiment of the present invention, the said locking member may form a spacer element which mutually separates the sub portions of the contact surface in the sealing position of the first body. The manoeuvring of the first body of the opening device from the sealing position into the basic position, which corresponds to opening of the package from the resealed state, is hereby facilitated. The spacer element namely enables the finger of a user to be introduced between the two mutually facing sub portions in order to prise these apart and thereby release the locking member.

According to another embodiment of the present invention, the said first body may be manoeuvrable between the said basic position and an opening position by folding about a second folding axis extended transversely to the said first folding axis. By manoeuvring the first body into the opening position, it becomes possible to arrange the package in an opened-up state which facilitates dispensing of the content of the package. A second hinge joint having an extent which coincides with the said second folding axis can here be configured in the said first body. It is hereby ensured that the folding about the second folding axis during manoeuvring of the first body from its basic position into its opening position is well-defined. The application surface may have, in the opening position of the first body, two sub portions angled relative to each other.

According to a further embodiment of the present invention, the opening device further comprises a second body extended along a longitudinal axis and having a second application surface for allowing application of the second body in the opening portion to a second of the said two side walls, wherein the second body is manoeuvrable between an unfolded position and a folded position by folding about a third folding axis, the second body being intended for manoeuvring into the said folded position in connection with manoeuvring of the first body into its opening position. The first and second body of the opening device are thus both folded in connection with opening of the package into its opened-up state and it hereby becomes possible to achieve a well-defined opening with a bottom corner having a lower opening angle which is sufficiently large to ensure that product residues, should these be fluid, are not detained in the opening portion under the influence of surface tension effects following completed dispensing of the content by a pouring process. The surface tension effects can vary in dependence on the product, so that the lower opening angle may be adapted to the particular type of product.

By suitable placement of the second body on the package and suitable configuration of the same, it can be assured that the second body has no bearing when the first body is manoeuvred from its basic position into the sealing position for resealing of the package. In particular, the said first body may have a first width and the said second body can have a second width, wherein the second width is less than half the first width. It hereby becomes possible to apply the second body to the package such that the package can be freely resealed by means of the first body.

According to another embodiment, the said first body may have a first length and the said second body may have a second length, wherein the second length is equal to or less than the first length. It hereby becomes possible to assure that the first and the second body can be freely manoeuvred into the opening position and second position respectively of the package for arrangement of the package in its opened-up state.

According to one embodiment, a third hinge joint having an extent which coincides with the said third folding axis may be configured in the said second body. It is hereby ensured that the folding about the third folding axis, when the second body is manoeuvred from its unfolded into its folded position, is well-defined.

One, some or all of the above-specified hinge joints may have a v-shaped or w-shaped cross section.

According to a further embodiment of the present invention, the said locking member may be designed for point locking. Alternatively, the locking member may be designed for linear locking.

According to a further embodiment of the opening device, the said locking member may be designed for mechanical locking. The locking member may be designed for mechanical locking by snap action. As an alternative to mechanical locking, the said locking member may be designed for locking with the aid of an adhesive.

According to another embodiment of the present invention, the body of the opening device may be made of a plastics material, such as PET, having a thickness within the range of 0.1-1 mm.

According to yet another embodiment, the application surface may be provided with an adhesive layer comprising a hot melt adhesive. Hereby, an opening device is provided which is non-sticky in room temperature and thus easy to handle. The adhesive layer of the opening device may be activated by exposure to heat in order to allow application on a package. The adhesive layer preferably covers the application surface. By the adhesive layer covering the entire application surface, it may be ensured that an end section of the package is properly folded upon manoeuvring the first body to the sealing position.

The adhesive layer may have an undulated surface. Hereby the capacity of the adhesive layer to store heat in connection with exposure to heat is enhanced, which may be beneficial in connection with application of the opening device on a package.

According to the present invention, a flexible package having an opening portion defined by two side walls, comprising an opening device which is disposed in the opening portion adjacent to an opening, formed upon initial opening of the package, for opening and closing thereof, which opening device comprises a thin-walled first body with a contact surface and a first application surface opposite thereto by which the first body is fastened to an external surface of a first of the said side walls of the package, and a locking member, is also indicated. The first body is manoeuvrable, by folding about a first folding axis, between a basic position and a sealing position, in which sealing position said contact surface has sub portions directly facing each other, and the locking member is disposed in at least one of the sub portions of the contact surface and is designed to act between the said sub portions in order to achieve releasable locking of the body in the said sealing position. The first folding axis of the first body is oriented parallel with said opening, and the package is manoeuvrable into a resealed state in which an end section of the opening portion comprising the said opening is folded about the said first folding axis by manoeuvring of the first body into the said sealing position.

According to one embodiment of the inventive package, the first body of the opening device may be manoeuvrable, by folding about a second folding axis extended transversely to the said first folding axis, between the said basic position and an opening position, wherein the package may be arranged in an opened-up state in which the side walls in the opening portion are separated by manoeuvring of the first body into the said opening position.

According to a further embodiment, the opening device further may comprise a second body extended along a longitudinal axis and having a second application surface by which the second body is fastened to an external surface of a second of the said two side walls, which second body is manoeuvrable, by folding about a third folding axis, between an unfolded position and a folded position, wherein the package may be arranged in the opened-up state by manoeuvring of the second body into the folded position in connection with manoeuvring of the first body into the opening position.

According to yet another embodiment, the first body and the second body may be disposed in the opening portion on the first side wall and second side wall respectively of the package such that the second body is situated within a region defined by the contour of one of the said sub portions of the first body. It is hereby ensured that the first body can be manoeuvred into its sealing position so as to reseal the package without influence from the second body.

According to another embodiment, the second folding axis of the first body may be parallelly displaced in relation to the third folding axis of the second body. By virtue of the fact that the first and the second body are applied with respectively the second and third folding axis parallelly displaced with respect to each other, opening of the package into its opened-up state is facilitated, since the folding is hereby controlled such that the bodies are folded in different directions.

The advantages which have been specified above with reference to the inventive opening device are in relevant parts also applicable to the inventive flexible package.

Terms in the claims should generally be interpreted according to their normal meaning within the technical field, unless otherwise expressly stated. All references to "a/the [element, device, component, member, step]" should be interpreted as a reference to at least a presence of the said element, device, component, member, step, etc., unless otherwise expressly stated. The steps of any method which is described herein do not have to be performed in exactly the described order, unless otherwise expressly stated.

BRIEF DESCRIPTION OF THE DRAWINGS

The above, as well as further objects, distinguishing features and advantages of the present invention, will be better understood as a result of the following illustrative and non-limiting detailed description of embodiments of the present invention with reference to the appended drawings, in which the same reference symbols will be used for elements of the same type.

DESCRIPTION OF ILLUSTRATIVE EMBODIMENTS

The present invention relates to an opening device for a flexible package and to a flexible package comprising such an opening device.

By a flexible package is meant a package or container which is made of a flexible material in the sense that the material is pliable. A flexible package of this kind may thus be made of a single-layered or multi-layered film material. The film material may comprise layers of plastic, such as PE, PP, PET, EVOH, and/or aluminium foil. Layers of plastic such as PE or PP may also comprise a filler, such as a mineral material.

Figure 1A:
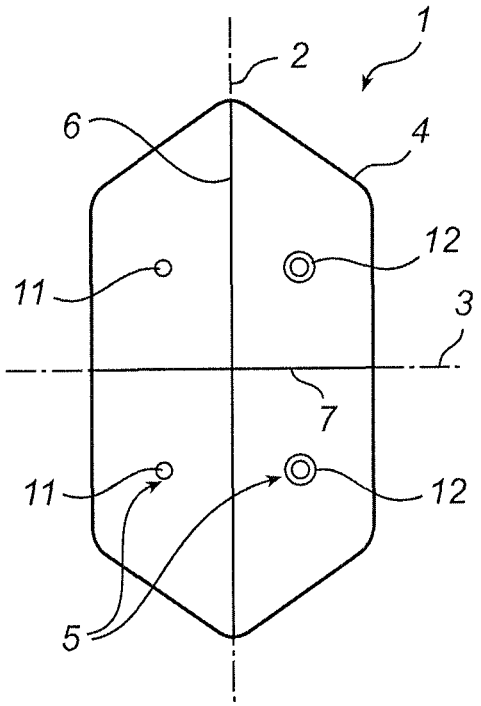
FIG. 1*a* shows a plan view of one embodiment of an opening device according to the present invention.
Figure 1B:
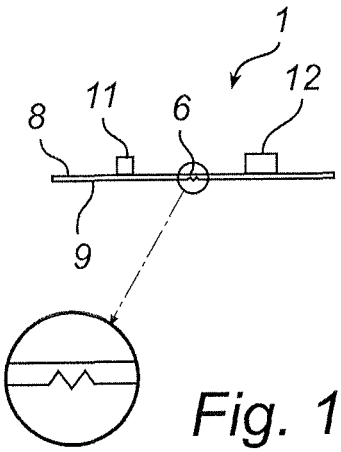
FIG. 1*b* shows a side view of the opening device shown in FIG. 1*a*.

In FIGS. 1*a* and 1*b*, to which reference is made, an embodiment of the inventive opening device 1 is illustrated.

The opening device 1 comprises a first body 4 extended along a first folding axis 2, and a locking member 5 disposed on the body 4.

The first body 4 can be made of a rigid, yet pliable plastics material, such as PET plastic, and can have a thickness within the range of 0.1-1 mm.

As in the embodiment shown, the first body 4 can have an elongated shape having parallel long sides, and short sides which are symmetrically bevelled.

According to the embodiment shown, the corners of the first body 4 are rounded to avoid scratch injuries to a user during handling of the inventive opening device 1.

It will be appreciated that the first body can be given a number of other configurations and that the first body can thus be given a rectangular shape or be provided with asymmetrically bevelled short sides, such as chamfered or straight cut short sides.

The first body 4 is manoeuvrable between a basic position for allowing opening of the package and a sealing position corresponding to a resealed state of the package, in which sealing position the said first body 4 is folded about the said first folding axis 2.

In the embodiment shown, a first hinge joint 6 having an extent which coincides with the said first folding axis 2 is configured in the said first body 4. The first hinge joint 6 has a w-shaped cross section, as can be seen from the detached partial enlargement in FIG. 1*b*, but it will be appreciated that the first hinge joint 6 can be configured differently, such as with a v-shaped cross section.

In the embodiment shown, it is thus the first hinge joint 6 which allows a well-defined folding about the first folding axis 2 for manoeuvring of the first body 4 into the said sealing position.

The first body 4 has a contact surface 8, on which the said locking member 5 is disposed, and an application surface 9, facing away from the contact surface 8, by which the said opening device 1 can be applied to the package.

The application surface 9 may be partly or preferably entirely covered by an adhesive (not shown) for enabling application of the opening device 1 to the package. The adhesive may be in the form of an adhesive layer in the form of a hot melt adhesive, also known as hot glue. In connection with application of the opening device 9 to the package, the adhesive layer may be activated by exposure to heat.

The contact surface 8 has two sub portions 10*a*, 10*b*, which are disposed on one side each of the first hinge joint 6 and which, when the first body 4 is in the said sealing position, are directly facing each other. The locking member 5, which according to the present invention is disposed in at least one of the said sub portions 10*a*, 10*b*, is designed, when activated, to act between the said sub portions 10*a*, 10*b* so as to detain the first body 4 in the said second position. By virtue of the fact that the sub portions 10*a*, 10*b* of the contact surface 8 are directly facing each other in the sealing position of the first body 4, it is ensured that nothing hinders the locking member 5 from acting between the said sub portions 10*a*, 10*b*.

Figure 3A:
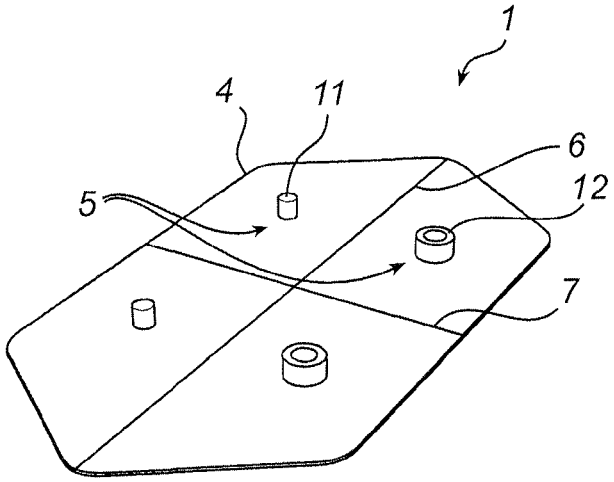
FIG. 3*a* shows a perspective view of the opening device shown in FIG. 1*a*, in a basic position.

The sub portions 10*a*, 10*b* of the contact surface 8 are illustrated schematically in FIG. 3*a*, to which reference is now made.

In the embodiment shown, the locking member 5 is configured in one piece with the first body 4 and is designed for mechanical and point locking of the body 4 in the said sealing position. More precisely, the locking member 5 comprises two male members 11, which by snap action can be brought into releasable locking engagement with their respective female member 12. Each pair of male and female members 11, 12 thus forms a push-button-like construction and the locking member 5 is thus activated by the pairs of male and female members 11, 12 being pressed one against the other in connection with the manoeuvring of the first body 4 into its sealing position.

The male members 11 are disposed on a first 10*a* of the said sub portions of the contact surface 8 and the female members 12 are disposed on a second 10*b* of the sub portions of the contact surface 8. It will be appreciated that the number of pairs of male and female members 11, 12 may also be less than or more than two.

It will further be appreciated that the locking member 5 may be configured differently. For example, the locking member may be designed for mechanical and linear locking of the body in its sealing position. Such a locking member may comprise an elongated male member, which by snap action can be made to engage with an elongated female member.

The locking member may alternatively be configured separately in relation to the first body. For example, the locking member may be configured in the form of an adhesive which is disposed on one of the two sub portions of the contact surface, which adhesive releasably adheres to the second of the two sub portions of the contact surface by manoeuvring of the first body into its sealing position.

The embodiment shown of the inventive opening device 1 is further manoeuvrable between the said basic position and an opening position, corresponding to an opened-up state of the package, by folding about a second folding axis 3 extending transversely to the said first folding axis 2. A second hinge joint 7 having an extent which coincides with the second folding axis 3 is configured in the said first body 4. The second hinge joint 7 can have a v-shaped cross section.

As in the embodiment shown, the second folding axis 3 can have an extent at right angles to the extent of the first folding axis 2, but it will be appreciated that the second folding axis 3 can also extend transversely to the first folding axis 2 with other angular relationships.

The second hinge joint 7 is configured such that the application surface 9 has, in the opening position of the first body 4, two sub portions 13*a*, 13*b* angled relative to each other.

Figure 3B:
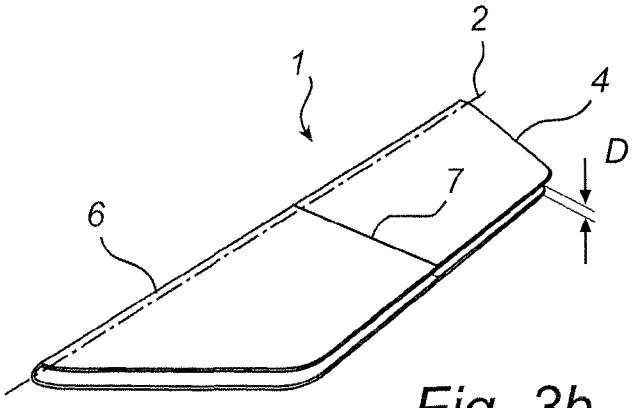
FIG. 3*b* shows a perspective view of the opening device shown in FIG. 1*a*, in a sealing position.

The sub portions 13*a*, 13*b* of the application surface 9 are illustrated schematically in FIG. 3*b*, to which reference now also is made.

The first hinge joint 6 and the second hinge joint 7 thus allow well-defined folding of the first body 4 in opposite directions. The first hinge joint 6 allows the first body 4 to be folded in such a direction that the sub portions 10*a*, 10*b* of the contact surface 8 are angled and are also turned towards each other, whilst the second hinge joint 7 allows the first body 4 to be folded in such a direction that the sub portions 13*a*, 13*b* of the application surface 9 are angled relative to each other.

The configuration of a first and a second hinge joint 6, 7 in the said first body 4 results in the first body 4 acquiring a bistable character. When the first body 4 is in its basic position, the first hinge joint 6 thus allows folding about the first folding axis 2, at the same time as the second hinge joint 7 allows folding about the second folding axis 3. The bistable character of the first body 4 means, however, that once folding has been initiated about one of the first and the second folding axes 6, 7, i.e. once the first body has been manoeuvred from its basic position, folding about the second of the first and second folding axes 6, 7 is not allowed.

Should the second hinge joint extend transversely to the first hinge joint at an angle different from 90°, it becomes possible to assure that the bistable character of the first body is maintained also in the folded state. In particular, folding about the second folding axis 7 is precluded when the first body is folded about the first folding axis 6 and is in the sealing position.

Figure 3C:
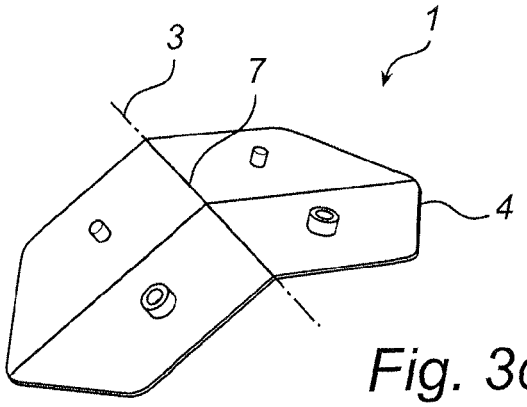
FIG. 3*c* shows a perspective view of the opening device shown in FIG. 1*a*, in an opening position.

In FIG. 3*a-c*, to which reference is now made, the first body 4 of the inventive opening device 1 is illustrated in its three different positions.

In FIG. 3*a*, the first body 4 of the opening device 1 is shown in its basic position, which corresponds to an unaffected position of the first body 4. The basic position represents a position which allows resealing or opening-up of the package, i.e. manoeuvring of the first body 4 into either its sealing position or its opening position.

In FIG. 3*b*, the first body 4 of the opening device 1 has been manoeuvred from the basic position into the said sealing position by folding about the first folding axis 2. The first hinge joint 6 ensures that the folding is well-defined about the said first folding axis 2.

It will be appreciated that the opening device 1 could also be configured without the first hinge joint 6. The first body 4 of the opening device 1 is here dimensioned such that it has the necessary rigidity, whilst it can still be bent about the first folding axis 2. The absence of a first hinge joint 6 means, however, that the folding is not as well-defined.

The locking member 5 is configured such that its pair of male and female members 11, 12 engage with each other under snap action and releasably lock the first body 4 in the sealing position. The sealing position represents a resealed state of the package.

As can be seen from FIG. 3*a*, each male member 11 is configured in the form of a projection and each female member 12 is formed by an opening in a protrusion. Both the projections and the protrusions jut out from the contact surface 8 and the locking member 5 hereby forms a spacer element 14 which mutually separates the sub portions 10*a*, 10*b* of the contact surface 8 when the male members 11 engage with the female members 12 in the sealing position of the first body 4. This separation is illustrated in FIG. 3*b* by means of the distance D. By virtue of the fact that the sub portions 10*a*, 10*b* are separated from each other in the sealing position of the first body 4, a user can easily introduce a finger between the said sub portions 10*a*, 10*b* in order to release the locking member 5 and open the opening device 1.

In FIG. 3*c*, the first body 4 of the opening device 1 has been manoeuvred from the basic position into the said opening position by folding about the second folding axis 3. The second hinge joint 7 ensures that the folding is well-defined about the said second folding axis 3. The third position represents an opened-up state of the package.

It will be appreciated that the opening device 1 could also be configured without the second hinge joint 7. The first body 4 of the opening device 1 is here dimensioned such that it has the necessary rigidity, whilst it can still be bent about the second folding axis 3. The absence of a second hinge joint 7 means, however, that the folding is not well-defined. Should an inventive opening device 1 without a second hinge joint 7 be applied adjacent to an opening in a flexible package containing a liquid product, the manoeuvring of the first body of the opening member from its basic position into its opening position could be realized by the user performing a pouring motion, whereby the product pressure opens up the opening in the flexible package and thus acts upon the first body of the opening device such that this is bent about the second folding axis.

The inventive opening device 1 allows resealing of flexible packages, and the opening device will be described below with reference to a first embodiment of an inventive package 15 according to FIG. 4*a*-4*e*, to which reference is now made.

The first embodiment is a flexible package 15 of the collapsing type, also referred to as a stand-up pouch. This type of package is suitable for liquid products and, as shown in the figures, can comprise a gas-filled handle.

An inventive opening device 1 of the type which has been described above with reference to FIGS. 1*a* and *b* and FIG. 3*a*-*c* is applied to the package 15 in an opening portion 16 of the package, which opening portion 16 is formed by two opposing side walls 17 of the flexible package 15 in a corner section of the same.

The opening portion 16 of the flexible package comprises in the unopened state of the package an end tab 18, which for initial opening of the package is separable from the package 15 by detachment along a separation line 19. The package 15 is shown in its unopened state in FIG. 4*a*.

The first body 4 of the opening device 1 is disposed on one of the said opposing side walls 17 adjacent to the end tab 18 of the opening portion 16, and, more precisely, is disposed on that side of the separation line 19 situated opposite the end tab 18, adjacent to and parallel with this same separation line.

The separation line 19 may be configured as an initiation for facilitating detachment of the end tab 18 from the package 15. The initiation may comprise treated and untreated portions. The treated portions may be configured as weakenings, perforations or the like.

The opening device 1 can be applied to the package 15 by the use of adhesive or by a heat-sealing process, or by some other suitable process. As mentioned above, the application surface of the opening 1 device may comprise an hot melt adhesive layer in order to facilitate application.

By virtue of the fact that the opening device is produced separately from the package, production of preformed packages which can be distributed in roll form to a filling plant, such as a dairy, is allowed. Such a roll of preformed packages may then be used in a filling machine to produce filled packages. The inventive opening device may in this case be applied to the package in the filling machine. The opening device may be applied to the package before, during or after the filling thereof.

Figure 4A:
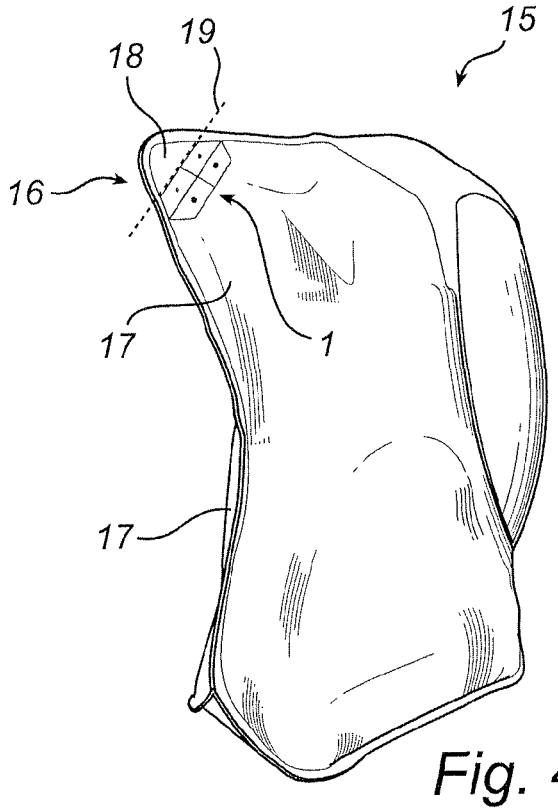
FIG. 4*a* shows a perspective view of a first embodiment of an inventive flexible package, in an unopened state.
Figure 4B:
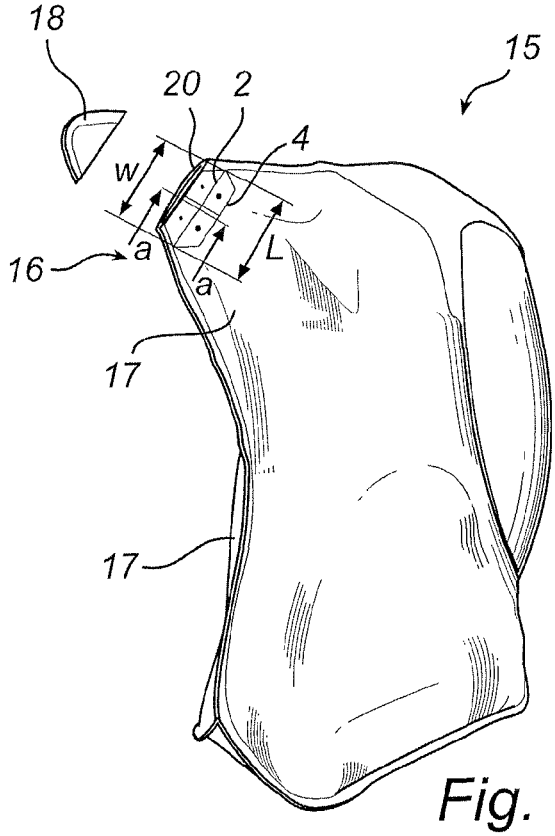
FIG. 4*b* shows a perspective view of the package shown in FIG. 4*a*, in an initially opened state.

In FIG. 4*b*, the end tab 18 has been separated from the package 15 for initial opening of the same, whereby an opening 20 is formed in the opening portion 16, which opening 20 allows a content housed in the package 15 to be poured out or dispensed. As can be seen from the figure, the opening device 1 is disposed adjacent to and parallel with the said opening 20.

In the figure, the opening device 1 is illustrated with its first body 4 in the basic position, which, as previously described, allows opening of the package 15.

Figure 4C:
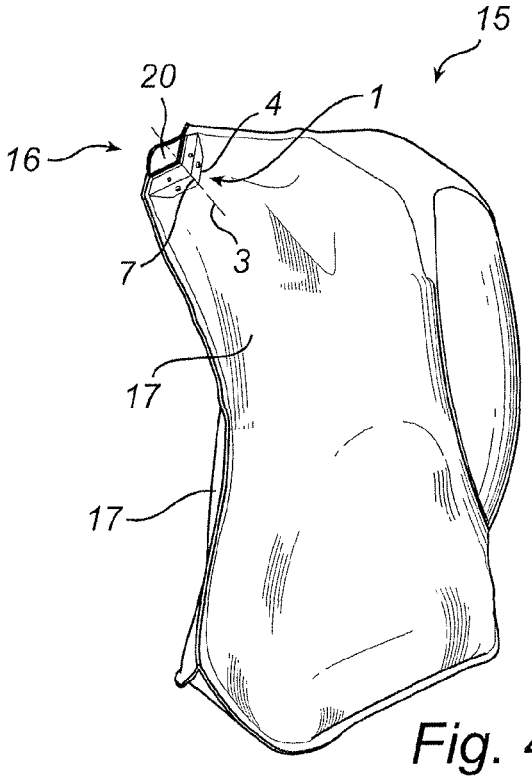
FIG. 4*c* shows a perspective view of the package shown in FIG. 4*a*, in a opened-up state.

In FIG. 4*c*, the package 15 is illustrated in an opened-up state. The first body 4 of the opening member 1 has here been manoeuvred from the basic position into the opening position by folding about the second folding axis 3, which folding is controlled by the second hinge joint 7. The manoeuvring is expediently realized by the user, with a thumb and index finger grip, pressing the two opposing short sides of the opening device 1 one against the other such that folding takes place about the second folding axis 3. By virtue of the fact that the opening device 1 is disposed on one side wall 17 of the package 15, part of this will accompany the opening device 1 during folding about the second folding axis 3, and will be separated from the second side wall 17, which can be made to bulge in the opposite direction. From FIG. 4*c*, it can be seen how the opening 20 in the opening portion 16 is opened up and acquires a well-defined pouring area when the first body 4 of the opening device 1 assumes the said opening position.

It will be appreciated that the opening position does not represent an exactly defined position, but is constituted by a position which can vary from one time to another. The purpose of the opening position is to achieve a pouring area for the opening 20 in the opening portion 16. It will also be appreciated that the first body may able to assume and maintain the opening position in response to a force load. This force load can be exerted by the product housed in the package, in connection with the performance of a pouring motion when the product reaches the opening portion 16 of the package.

Due to the bistable nature of the opening device 1, folding of the first body 4 of the opening device 1 about the said first folding axis 2 is not allowed as long as the first body 4 of the opening device 1 is in the opening position. It should here be noted that the first body 4 is not fully folded about the second folding axis 3 in the third position, which is also why the bistable character is maintained in the opening position despite the fact that the second hinge joint 7, in the embodiment shown, extends transversely to the first hinge joint 6 at a right angle.

Figure 4D:
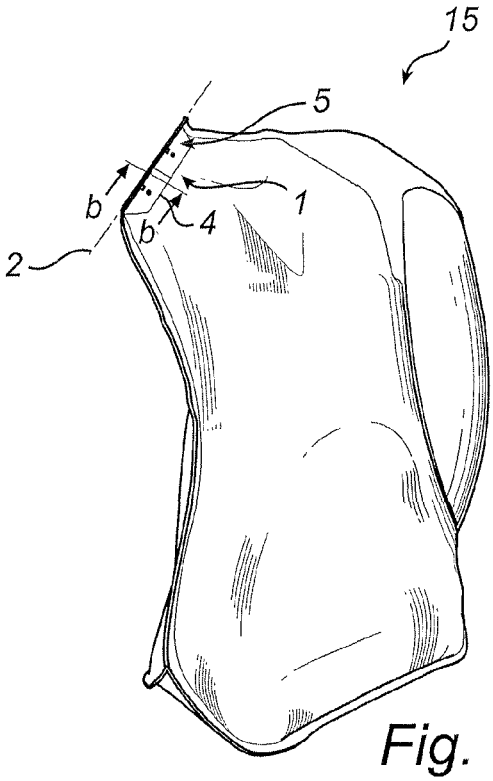
FIG. 4*d* shows a perspective view of the package shown in FIG. 4*a*, in a state when it is about to be resealed.
Figure 4E:
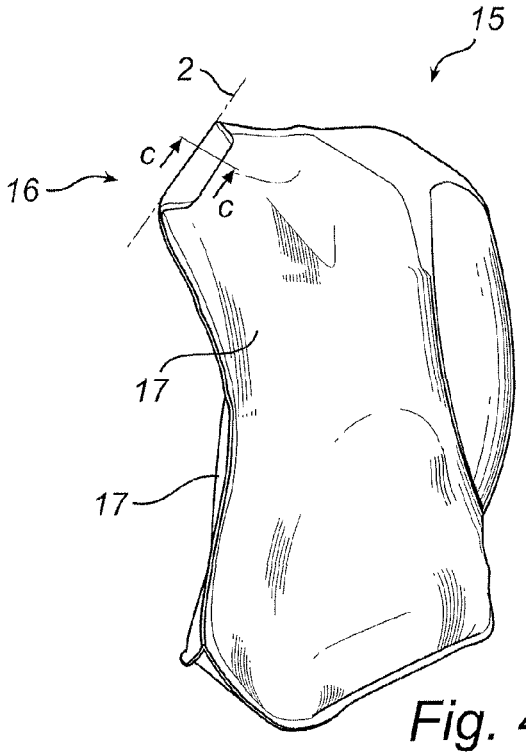
FIG. 4*e* shows a perspective view of the package shown in FIG. 4*a*, in a resealed state.

In FIGS. 4*d* and 4*e*, the process for resealing the opened package 15 is shown. To begin with, the first body 4 of the opening device 1 is returned from the opening position into the basic position by folding about the second folding axis 3 (not shown). After this, the first body 4 is folded about the first folding axis 2, and in FIG. 3*d* it is shown how the folding has been started and in FIG. 3*e* the first body 4 is shown in the sealing position following completed folding. The locking member 5 has here been activated and thus ensures that the first body 4 is detained in the said sealing position.

Due to the bistable nature of the opening device 1, folding of the first body 4 of the opening device 1 about the said second folding axis 3 in connection with the folding of the first body 4 about the first folding axis 2 is not allowed. It should here be noted that the first body 4 is fully folded about the first folding axis 2 in the sealing position. Since the second hinge joint 7, in the embodiment shown, extends transversely to the first hinge joint 6 at a right angle, the bistable character of the first body may cease when the first body assumes the sealing position.

Since the opening device 1 and its first body 4 are disposed on one side wall 17 of the package 15, part of this side wall 17 will be folded, together with the opening device 1, in the course of the folding about the first folding axis 2 and will thus also drag with it part of the second side wall 17. Consequently, manoeuvring of the first body 4 of the opening device 1 from the basic position into the sealing position causes an end section comprising the said opening 20 in the opening portion 16 to be bent over the first folding axis 2, with the result that the package 15 is resealed, as can thus be seen from FIG. 4*e*.

As in the embodiment shown, the opening device 1 can be configured such that it has a length L which substantially conforms to a width W of the opening portion 16 in the same position, that is to say measured along a line coinciding with the second folding axis 2. More precisely, the sub portions 10*a*, 10*b* of the contact surface 8 of the first body 4 adjoin each other along a boundary portion extending along substantially the full width W of the opening portion. Preferably, the length of the opening device 1 somewhat exceeds the width W of the opening portion 16. It is hereby ensured that a relatively tight resealing is achieved, which has a positive effect on the taste and shelf-life of the product enclosed in the package 15. A tight resealing further minimizes the risk of spillage if the package were to overturn.

The first hinge joint 6 configured in the first body 4 of the opening device 1 may have, as previously described, a w-shaped cross section. The advantage with a first hinge joint 6 which is configured in this way will be described below in greater detail with reference to FIG. 5*a*-5*c*, which schematically show the inventive opening device 1 applied to one side wall 17 of the package 15 adjacent to the opening 20 in the opening portion 16.

Figure 5A:
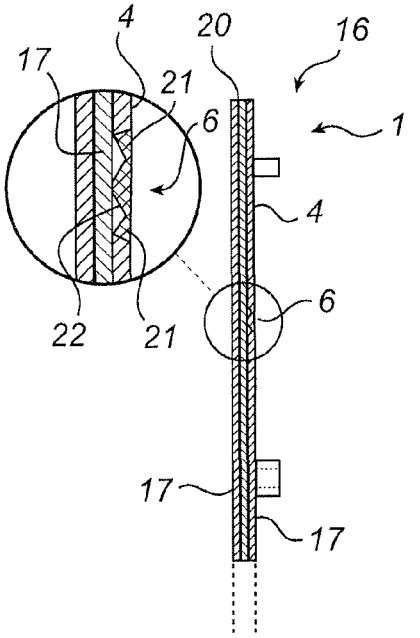
FIG. 5*a* shows a cross-sectional view taken along the line a-a in FIG. 4*b*.

The first hinge joint 6 of the first body has a w-shaped cross section, which can be said to comprise two legs 21 and an intervening ridge 22, as can be clearly seen from the detached partial enlargement in FIG. 5*a*, in which the w-shaped cross section is marked. The "free" ends of the legs 21 of the cross section connect to one half each of the first body 4 of the opening device 1. The w-shaped cross section is oriented such that the ridge 22 is facing towards the side wall 17 of the package 15.

In FIG. 5*a*, the opening device 1 is illustrated with its first body 4 in the basic position.

Figure 5B:
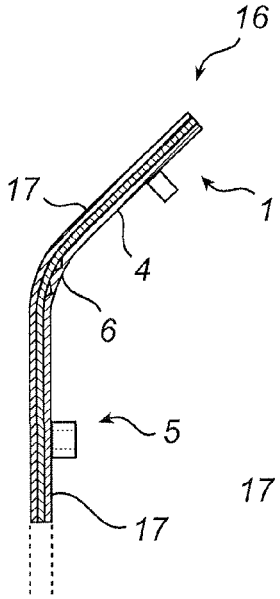
FIG. 5*b* shows a cross-sectional view taken along the line b-b in FIG. 4*d*.

In FIG. 5*b*, it is illustrated how a user has started acting upon the opening device 1 to manoeuvre the first body 4 from its basic position into the sealing position, wherein the first hinge joint 6 controls the folding about the first folding axis 2. It can here be seen how that part of the first body 4 which is folded drags with it the side wall 17 directly connected thereto, which in turn drags with it the second of the side walls 17. By folding of the first body 4 about the first folding axis 2, the said end section of the opening portion 16 will consequently be folded over the said first folding axis 2.

Figure 5C:
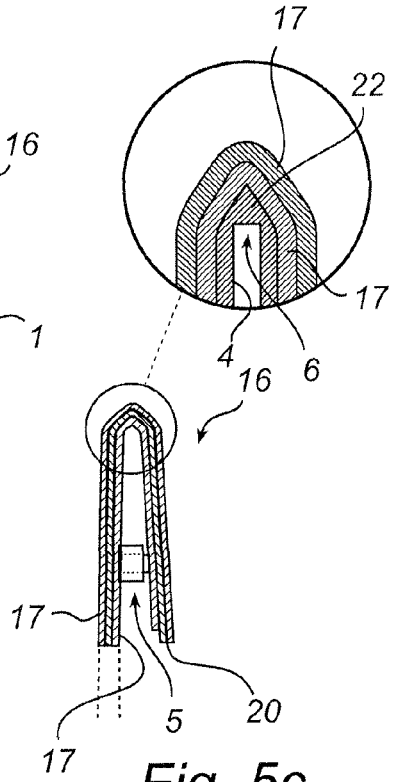
FIG. 5*c* shows a cross-sectional view taken along the line c-c in FIG. 4*e*.

In FIG. 5*c*, it is illustrated how the first body 4 of the opening device 1 has been manoeuvred into the sealing position, in which the locking member 5 has been activated in order to maintain the said sealing position. The side walls 17, and the thereby defined opening portion 16, are folded about the first folding axis 2. From the detached partial enlargement in FIG. 5*c*, it can be seen how the side walls 17 are stretched and are pressed against the ridge 22 of the w-shaped cross section of the first hinge joint 6 when the first body 4 assumes the said sealing position. This stretching and pressing helps to increase the reliability of the resealing capability of the opening device 1.

The hinge joints may be formed by a thermo forming operation. The w-shape of the first hinge joint 6 may be accomplished such that material is moved from the recesses towards the ridge, which consequently can be made to protrude from the contact surface 8 of the first body 4.

In the figures, the legs of the w-shaped cross section are angled. However, the legs may be perpendicular towards the contact surface 8. As a consequence, no material will in this case be displaced in a direction from the ridge in connection with forming of the first hinge joint by a thermo forming operation.

Practical trials have shown that the resealing can be made sufficiently tight that a package housing a liquid product, when the package has been opened and resealed with the aid of the inventive opening device 1, can be turned up and down without leakage.

It will be appreciated that the inventive opening device 1 does not just need to be used in combination with packages of the above-described type.

It is thus conceivable to use the opening device together with a flexible pillow-shaped package. According to a second embodiment of an inventive resealable flexible package 15', which second embodiment is illustrated in FIG. 6*a*-6*b*, an inventive opening device 1 is disposed in an opening portion 16, which is formed by two opposing side walls 17 of the flexible package 15' in a corner section of the same.

The opening device 1, which, as previously, comprises a first body 4, is more precisely disposed on one of the said opposing side walls 17 adjacent to an end tab 18 of the opening portion 16, which end tab 18 is separable from the package 15' by detachment along a separation line 19. The opening device 1 is disposed on that side of the separation line 19 situated opposite the end tab 18, adjacent to and parallel with this same separation line.

A flexible resealable package 15' according to the said second embodiment is well suited to a particulate content, such as peanuts or sweets. It will be appreciated, however, that this type of package can also hold other types of content, such as a liquid content.

Figure 6A:
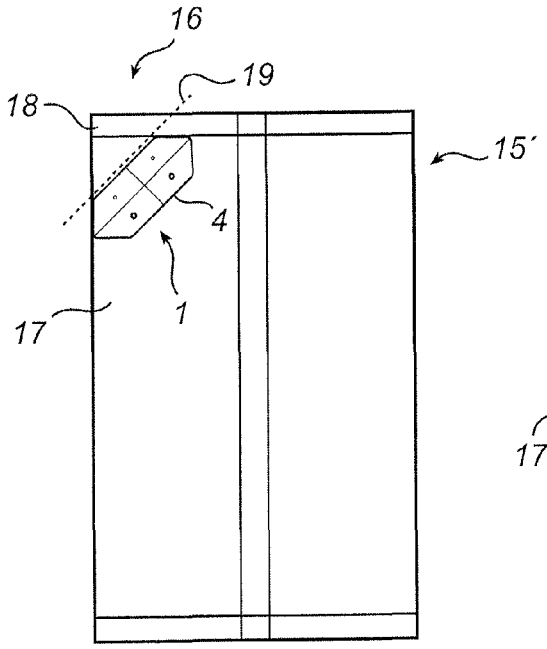
FIGS. 6*a* and 6*b* show a second embodiment of an inventive flexible package, in an unopened and resealed state, respectively.
Figure 6B:
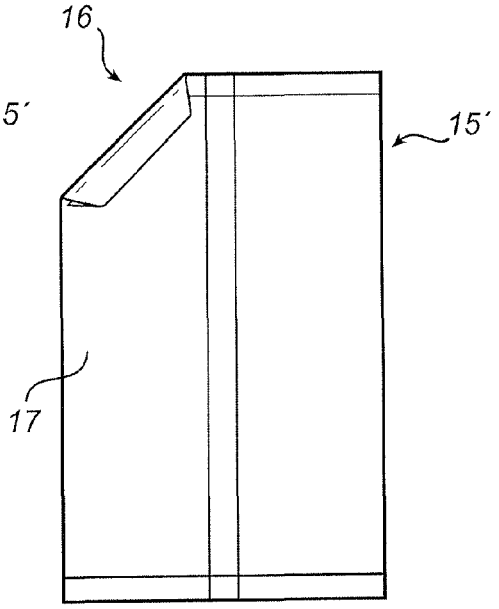

In FIG. 6*a*, the package 15' is shown in an unopened state, and in FIG. 6*b* the end tab 18 has been separated along the indicated separation line 19, which enables the package 15' to be opened up by manoeuvring of the opening device 1 into the opening position of the first body 4 in a manner corresponding to that which has been described above in connection with the first embodiment of a flexible resealable package 15, or by manoeuvring of the opening device 1 into the sealing position of the first body 4 in order to reseal the package 15', as is also shown in FIG. 6*b*.

Figure 7A:
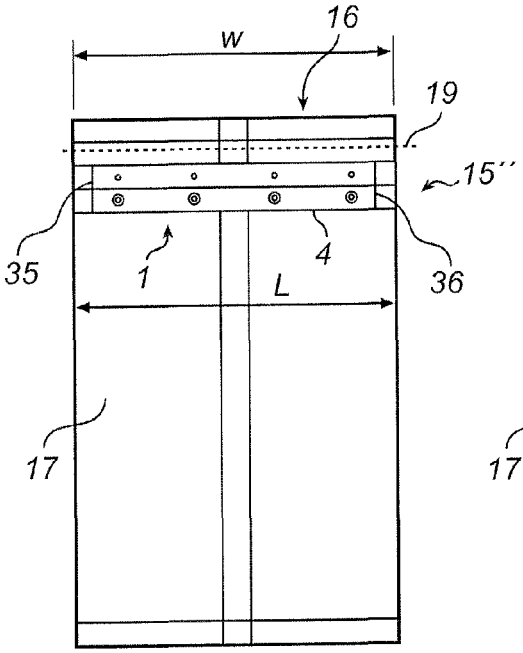
FIGS. 7*a* and 7*b* show a third embodiment of an inventive flexible package, in an unopened and resealed state, respectively.
Figure 7B:
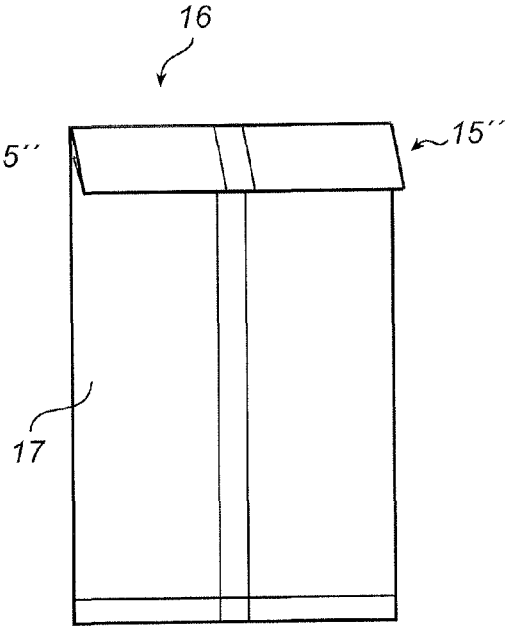

It will further be appreciated that the inventive opening device 1 does not necessarily have to be applied in an opening portion forming part of a corner section of the package. In FIG. 7*a*-*b*, to which reference is now made, a flexible resealable package 15" according to a third embodiment is illustrated.

The package 15" has an opening portion 16 defined by two opposing side walls 17 of the package 15". The opening portion 16 comprises an end tab 18 forming a top portion of the package 15", which end tab 18 is separable from the package 15" along a separation line 19. The opening device 1 comprising a first body 4 is disposed in the opening portion 16 adjacent to its end tab 18 and is parallelly arranged with respect to the said separation line 19.

The opening device 1 has a length L which substantially conforms to the width W of the opening portion 16 measured along a line coinciding with the second folding axis 2. It will be appreciated that, for a rectangular package such as that which is shown in the figures, this width W corresponds to the width of the package itself. The package 15" according to the said third embodiment is shown in FIG. 7*a* in an unopened state and in FIG. 7*b* in a resealed state.

The first body 4 of the opening device 1 has in the embodiment shown a rectangular shape, i.e. the first body 4 has straight cut short sides.

The first body 4 of the opening device 1 also has two further hinge joints 35, 36, which are each disposed in a respective end portion of the first body 4. The further hinge joints 35, 36 extend transversely to the first hinge joint 2. The purpose of the further hinge joints 35, 36 is to facilitate the manoeuvring of the inventive opening device. The hinge joints 35, 36 delimit, more precisely, a gripping tab at the respective end of the first body 4, which gripping tabs can be gripped by a user in connection with manoeuvring of the first body into its opening position.

As can be seen from the figure, the first body does not in the embodiment shown have a second hinge joint which controls the folding about the second folding axis in connection with manoeuvring of the body into its opening position.

Figure 8A:
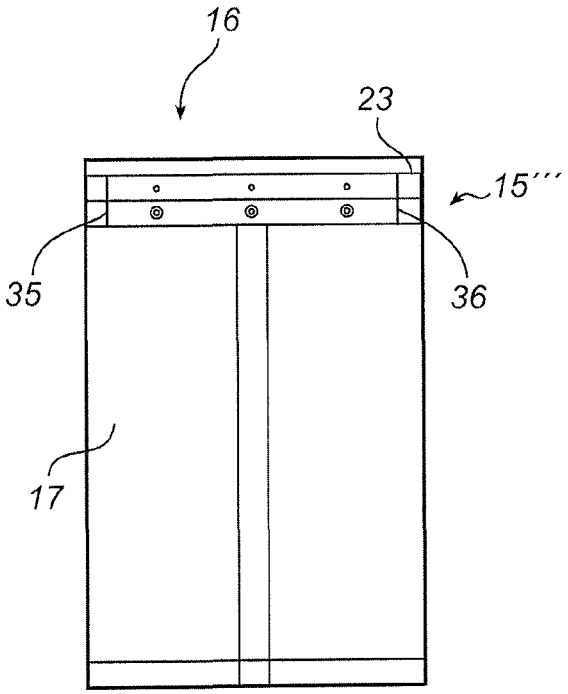
FIGS. 8*a*, 8*b* and 8*c* show a fourth embodiment of an inventive flexible package, in an unopened, an opened-up and a resealed state, respectively.
Figure 8B:
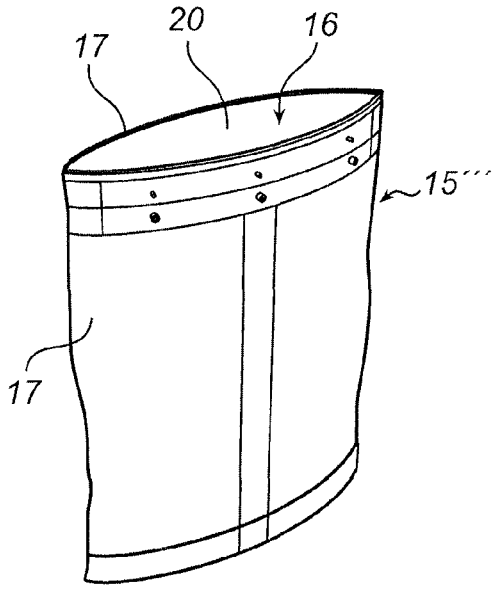
Figure 8C:
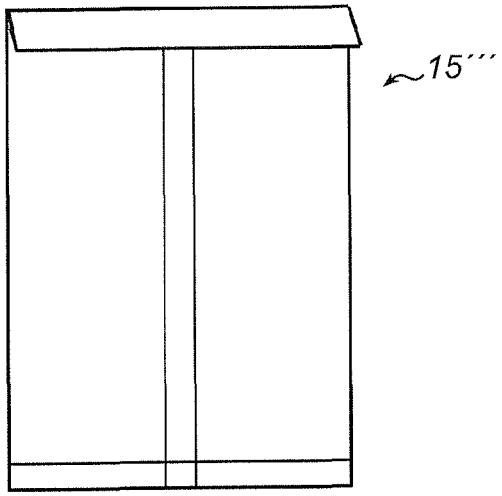

It will also be appreciated that the opening portion 16 does not need to comprise a separable end tab. In FIG. 8*a*-8*c*, to which reference is now made, a fourth embodiment of an inventive resealable flexible package 15''', which comprises an opening portion 16 defined by two opposing side walls 17 of the package 15''', is illustrated. The opening portion 16 forms part of a top portion of the package 15''' and is openable by separation of the side walls 17 of the package 15''' in order to break a transverse edge seal 23 along which the two side walls 17 of the package 15''' are mutually connected. The opening device 1 is disposed in the opening portion 16, parallel with the said edge seal 23.

The package 15''' according to the said fourth embodiment is shown in FIG. 8*a* in an unopened state, in 8*b* in an opened-up state and in FIG. 8*c* in a resealed state. In this embodiment, too, of the present invention, the opening device is illustrated with two further hinge joints 35, 36 of the first body 4, which further hinge joints 35, 36 delimit their respective gripping tab in order to facilitate the manoeuvring of the opening device 1.

Figure 9:
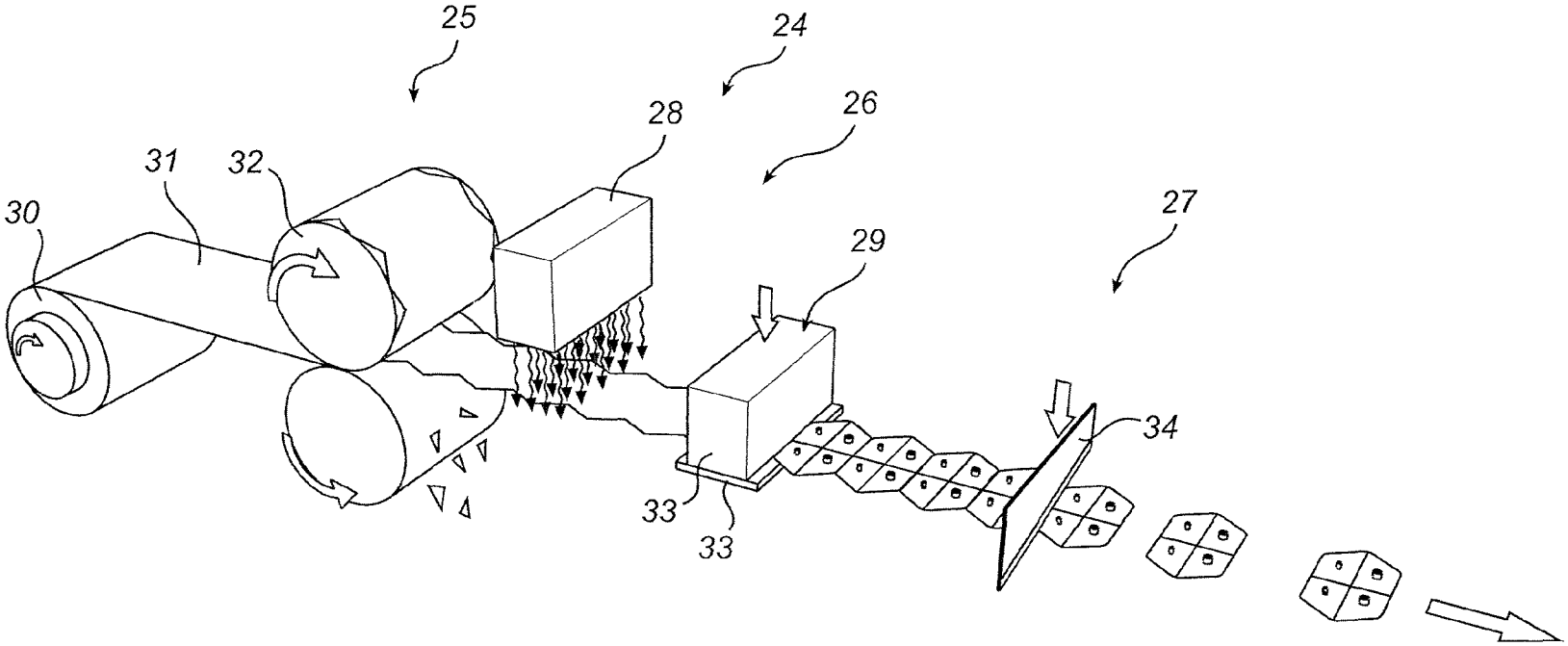
FIG. 9 shows a schematic production line for the production of an inventive opening device.

A process for producing inventive opening devices will be described below with reference to FIG. 9, which shows a production line 24 comprising a punching station 25, a forming station 26 and a separating station 27. In the embodiment shown, the forming station 26 comprises a heating unit 28 and a pressing unit 29.

The material from which the opening devices shall be produced is supplied in the form of a roll 30 from which a material web 31 is unrolled and is led to the various stations.

The material web 31 initially reaches the punching station 25, which in the embodiment shown comprises a rolling press 32 which engages with the side edges of the material web 31 in order to punch out a profile which meets the desired shape of the short sides of the opening devices.

The material web 31 thereafter reaches the heating unit 28 of the forming station 26, in which the material web 31 is heated to a temperature necessary for thermoforming. In practice, it has shown to be suitable to heat a material web made of PET to a relatively low thermoforming temperature, such as 100° C.

When the material web 31 is subsequently led up to the pressing unit 29 of the forming station 26, a tool 33 comprising two tool halves engages with the heated material web 31 for thermoforming thereof. The tool 33 is thus configured such that, upon engagement with the material web 31, it thermoforms hinge joints and locking members of the respective opening device. The tool 33 can also comprise cooling members for cooling the material web following completed thermoforming. Alternatively, cooling members, should such be required, can be arranged separately from the forming station 26.

Finally, the material web 31 reaches the separating station 27 and in the embodiment shown a knife member 34 engages with the material web 31 for detachment of individual opening devices 1.

It will be appreciated that the heating unit 28 and the pressing unit 29 can be integrally configured. It will also be appreciated that the separating station 27 can be integrated in the forming station 26.

It will also be appreciated that the punching station can be dispensed with. The short sides of the opening device may be realized by preformed side edges of the material web. Alternatively, the separating station can be designed to cut all sides of the respective opening device.

Also, the separating station may be dispensed with. In this case, the web of interconnected opening devices may be rolled up in order to be supplied in roll-form to a filling machine.

The production line may be arranged to produce a web of interconnected opening devices comprising a plurality of opening devices in the transverse direction of the web. A roll comprising such a web of interconnected opening devices may be used in a filling machine arranged for filling packages in parallel fillings stations.

Further, the production line may also comprise an adhesive application station. The adhesive application station may be arranged to apply an adhesive layer partly or preferably entirely covering the application surface of each opening device. The adhesive layer may be in the form of a hot melt adhesive, also known as hot glue. The adhesive layer may be formed with an undulated or wave-formed surface.

The opening device can be applied to the package in connection with or following the production of the package.

It is also possible to apply the inventive opening device to the package before, during or after the filling thereof.

In particular, it is possible to apply an inventive opening device to a preformed package in the filling machine before the package has been filled.

The filling machine may comprise an applicator for application of said opening devices which as mentioned above may be supplied in said roll-form.

The applicator may comprise a knife or the like arranged to separate a single opening device from the web of interconnected opening devices. The knife may optionally be arranged to cut the contour of the opening devices to suitable shape.

The separating station can further comprise an indexable holder, which, following separation of an opening device, moves the separated opening device into a position in which the opening device can be applied in the opening portion of a filled package.

In case the opening devices comprise an adhesive layer in the form of a hot melt adhesive, the applicator may comprise a heater arranged to activate the adhesive layer. The heater may be a radiation-heater or a hot-air heater. If the surface of the adhesive layer is undulated or wave-shaped, the ridges of the surface will accumulate heat and ensure that the adhesive layer is still active in connection with application of the opening device on a package.

Alternatively, the heater may be in the form of a contact heater which is pressed against the adhesive layer. The contact ensures controlled heat transfer to the adhesive layer and may be provided with a surface treatment in order to prevent the adhesive layer from adhering to the contact heater. The contact heater may be provided with a surface profile in order to accomplish the undulated of wave-shaped surface of the adhesive layer.

The heater may affect the hinge joints of the opening device. For a w-shaped hinge joint, the bottom of the recesses and the top of the ridge may be rounded as a consequence of the heat exposure. The rounded bottom of the recesses may negatively affect the folding capability of the opening device. By forming the legs of the w-shaped cross section such, as previously described, that these are perpendicular to the contact surface, rounding of the recesses in connection with heat exposure may be avoided.

According to another aspect, the filling machine may comprise equipment which allows the production of opening devices, such as equipment which allows execution of the process described with reference to FIG. 8. The separating station can here be designed to cut all sides of the respective opening device in connection with the separation thereof. The separating station can further comprise an indexable holder, which, following separation of an opening device, moves the separated opening device by a rotary motion into a position in which the opening device can be applied in the opening portion of a filled package.

Figure 2A:
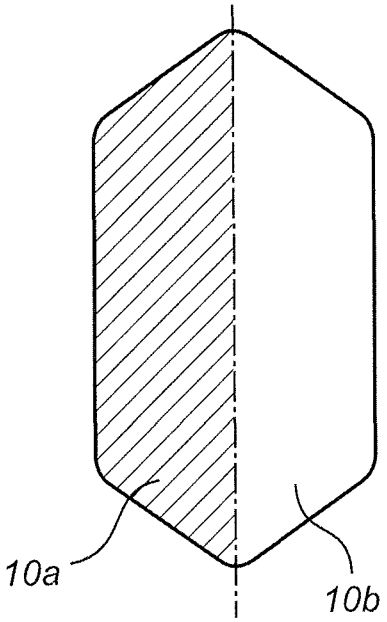
FIGS. 2*a* and 2*b* are plan views which schematically show the sub portions of the contact surface and application surface, respectively, of the first body of the opening device shown in FIG. 1.
Figure 2B:
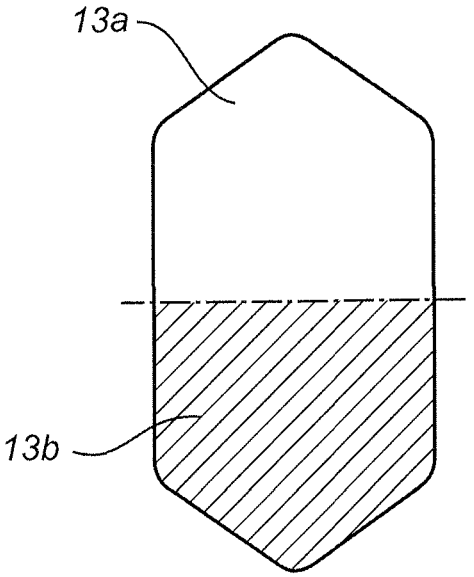

According to a further embodiment of the inventive opening device, which will be described below with reference to FIG. 10-15, the opening device 1 comprises a first body 4, as described above with reference to FIG. 1-3, and a second body 40.

Figure 10:
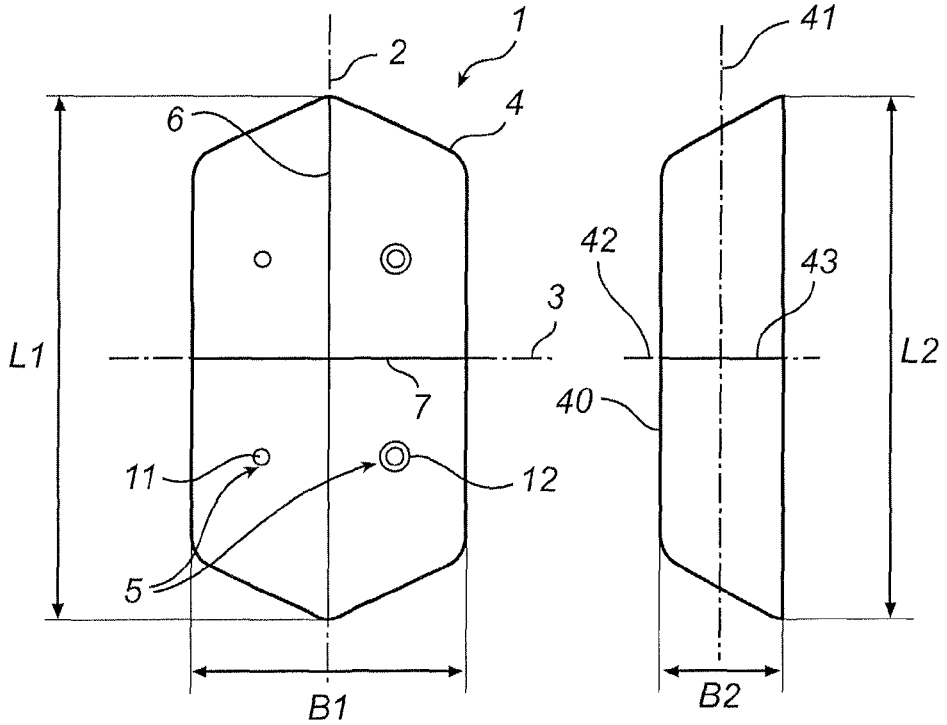
FIG. 10 shows a plan view of a further embodiment of an inventive opening device.

The first body 4 and second body 40 of the opening device 1 are illustrated in FIG. 10. The second body 40 extends along a longitudinal axis 41 and has a second application surface for allowing the second body 40 on a package.

Figure 11:
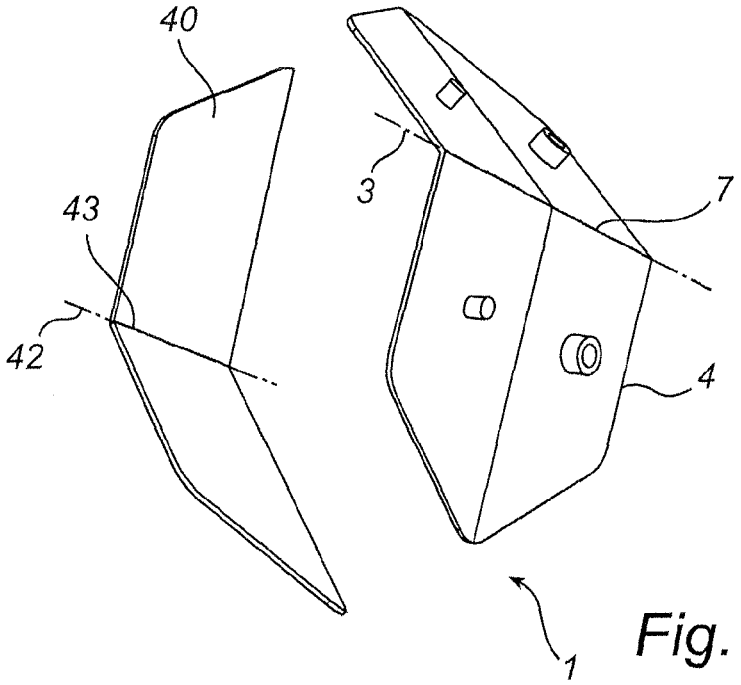
FIG. 11 shows a perspective view of the opening device shown in FIG. 10, in which a first body is shown in an opening position and a second body is shown in a folded position.

The second body 40 is further manoeuvrable between an unfolded position and a folded position by folding about a third folding axis 42. In FIG. 11, the opening device 1 is illustrated with its first body 4 in its third position and its second body 40 in its folded position.

The third folding axis 42 of the second body 40 can extend, as in the embodiment shown, at right angles to the longitudinal axis 41, but it will be appreciated that it is also possible to arrange the third folding axis 42 such that this extends at a non-right angle in relation to the said longitudinal axis 41. In particular, the second folding axis 3 of the first body 4 can be angled in relation to the third folding axis 42 of the second body 40 such that the said folding axes are parallel in a state applied to a package.

A third hinge joint 43 having an extent which coincides with the said third folding axis 42 can be configured in the second body 40. The third hinge joint 43 can have a v-shaped or w-shaped cross section.

The second body 40 further has a width B2 which is less than half the width B1 of the first body 4. The second body 40 further has a length L2 which is equal to or less than the length L1 of the first body 4.

It will be appreciated that the end portions of the first body 4 and the second body 40 can be configured other than is shown in the figures for adaptation to the geometry in the opening portion of the package on which the opening device 1 is intended to be disposed.

Figure 12A:
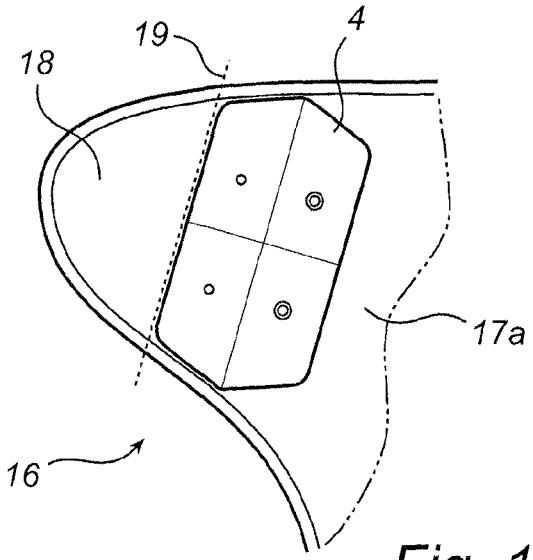
FIG. 12*a*-12*c* show detached plan views of a flexible package, with the opening device shown in FIG. 10 applied in an opening portion thereof.
Figure 12B:
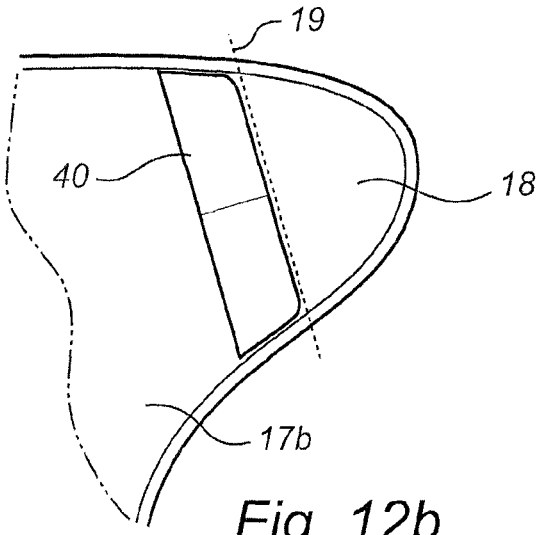
Figure 12C:
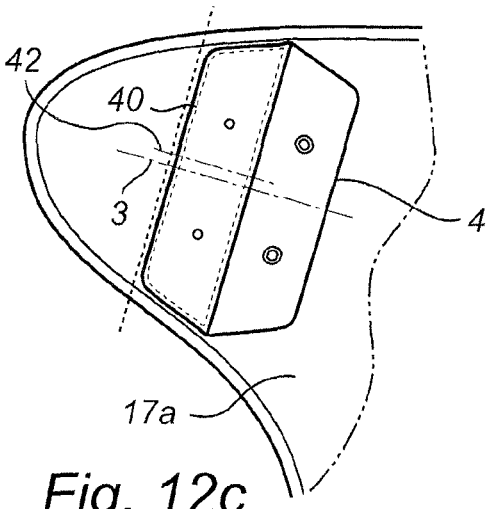

In FIG. 12*a*-12*c*, an opening portion 16 of a flexible package is illustrated, which opening portion 16 is formed by two opposing side walls 17*a*, 17*b* of the flexible package in a corner section of the same. An opening device 1 according to the said further embodiment is disposed in the said opening portion 16.

The opening portion 16 of the flexible package comprises in the unopened state of the package an end tab 18, which for initial opening of the package is separable from the package by detachment along a separation line 19.

The first body 4 of the opening device 1 is disposed on a first 17*a* of the said opposing side walls 17*a*, 17*b*, adjacent to the end tab 18 of the opening portion 16, and, more precisely, is disposed on that side of the separation line 19 situated opposite the end tab 18, adjacent to and parallel with this same separation line, as can be clearly seen from FIG. 12*a*.

The second body 4 of the opening device 1 is disposed on a second 17*b* of the said opposing side walls 17*a*, 17*b*, adjacent to the end tab 18 of the opening portion 16, and, more precisely, is disposed on that side of the separation line 19 situated opposite the end tab 18, adjacent to and parallel with this same separation line, as can be clearly seen from FIG. 12*b*.

The separation line 19 can be configured as a initiation for facilitating detachment of the end tab 18 from the package. The initiation can comprise treated and untreated portions. The treated portions can be configured as weakenings, perforations or the like.

The opening device 1 can be applied in the opening portion 15 by the use of adhesive, such as a hot melt adhesive as described above, or by a heat-sealing process, or by some other suitable process.

As has been described above, the second body 40 has a length L2 which is equal to or less than the length L1 of the first body 4 and has a width B2 which is less than half the width B1 of the first body 4. It hereby becomes possible to dispose the second body 40 within a region on the second side wall 17*b*, which region, in the state of the opening device 1 applied to the package, is defined by the contour of one sub portion 10*a* of the contact surface 8 of the first body 4, as can be clearly seen from FIG. 12*c*.

From FIG. 12*c*, it can also be seen that the bodies 4, 40 are mutually arranged such that the third folding axis 42 of the second body 40 is parallelly displaced in relation to the second folding axis 3 of the first body 4. The folding axes 3, 42 can be parallelly displaced with respect to each other with a distance apart A within the range 1-3 mm, but it will be appreciated that the parallel displacement can be greater or less than this. In certain applications, the parallel displacement can be wholly dispensed with.

Figure 13A:
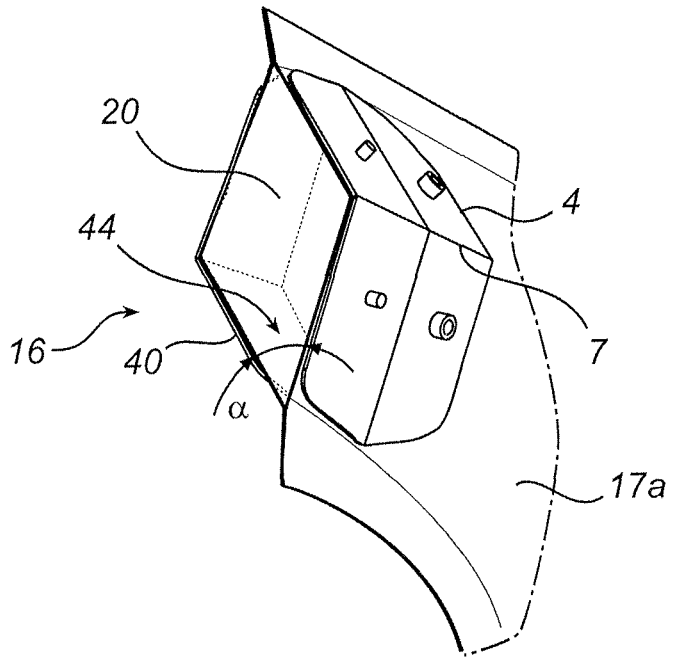
FIG. 13*a*, 13*b* show detached perspective views of the package shown in FIG. 12*a*-12*c*, in an opened-up state.
Figure 13B:
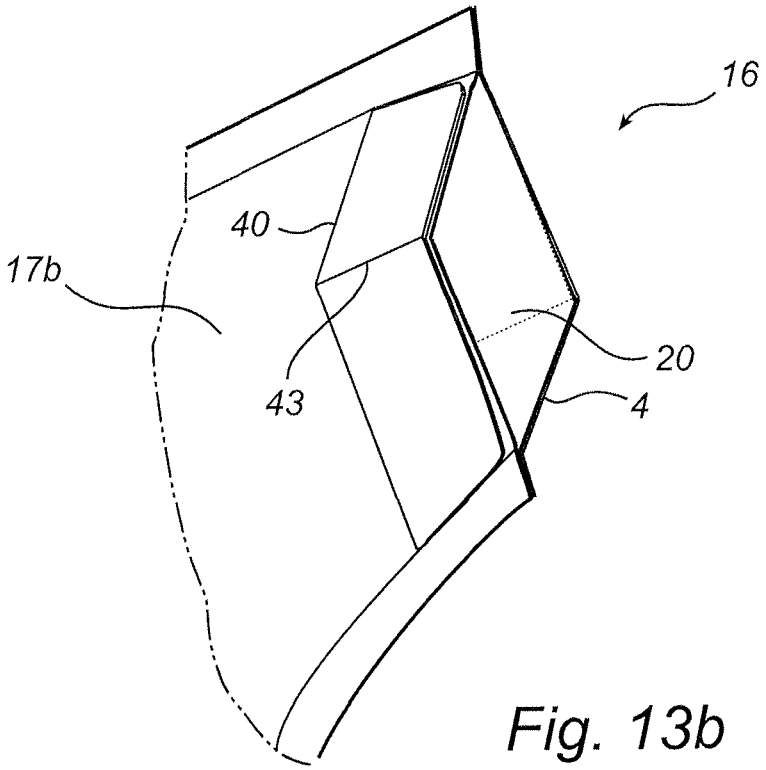

For initial opening of the package, its end tab 18 is removed, and for further opening of the package into its opened-up state, the first body 4 is manoeuvred into its opening position and the second body 40 into its folded position, as is illustrated in FIGS. 13*a* and 13*b*. In practice, the first body 4 is manoeuvred into its opening position and the second body 40 into its folded position simultaneously, by a user, with a thumb and index finger grip, pressing opposing short sides of the opening device 1 one against the other such that folding takes place about the second folding axis 3 and about the third folding axis 42 respectively. By virtue of the fact that the bending axes 3, 42 in the embodiment shown are parallelly displaced, it is ensured that the folding takes place in opposite directions. From the figures, it can be seen how the opening 20 in the opening portion 16 is opened up and acquires a well-defined pouring area having a contour which assumes the form of a parallelogram.

As can be seen from the figures, the first body 4 and the second body 40 are configured so that these do not extend beyond the connecting portion in which the side walls 17*a*, 17*b* of the package are mutually connected, but keep within the width of the opening portion. One of the said bodies 4, 40 could be permitted to have an extent beyond the said connecting portions, but the fact that at least one body lacks such an extent ensures that the two bodies 4, 40 do not counteract each other in connection with opening of the package into its opened-up state.

The said further embodiment of the inventive opening device 1 minimizes the incidence of drips after a completed pouring process. Surface tension effects namely imply that remaining product residues can be better detained between the side walls 17*a*, 17*b* in the bottom corners 44 of the opening 20. The opening device produces, however, a lower opening angle $\alpha$ of the opening 20, which lower opening angle $\alpha$ is large enough to overcome these surface tension effects. It is thus the second body 40 which, when the package is opened into its opened-up state, strives to angle the second side wall 17*b* away from the first side wall 17*a* to a sufficient degree to allow the attainment of a lower opening angle $\alpha$ which is sufficiently large.

Where an opening device without a second body is used on a package, it can happen that the second side wall along a short distance extends parallel with the first side wall so as subsequently to be angled off. When the first body is used together with a second body, as in the embodiment shown, it is ensured that the second side wall 17*b* is angled off from the first side wall 17*a* at a well-defined lower opening angle, which is advantageous for overcoming the surface tension effects which strive to detain product residues in the opening portion.

The lower opening angle $\alpha$ which is required to overcome the surface tension effects is dependent on the product which is housed in the package. For example, the lower opening angle $\alpha$ needs to be greater for milk than for water. The lower opening angle $\alpha$ can be within the range 15-65° or, more preferably, within the range 35-55°.

As has been described above, the opening device 1 does not need to be configured such that the opening position of the first body 4 and the folded position of the second body 40 are identical in each manoeuvring operation for opening up a package. This means that the lower opening angle $\alpha$ can be permitted to vary somewhat with repeated openings of the package into its opened-up state.

Figure 14:
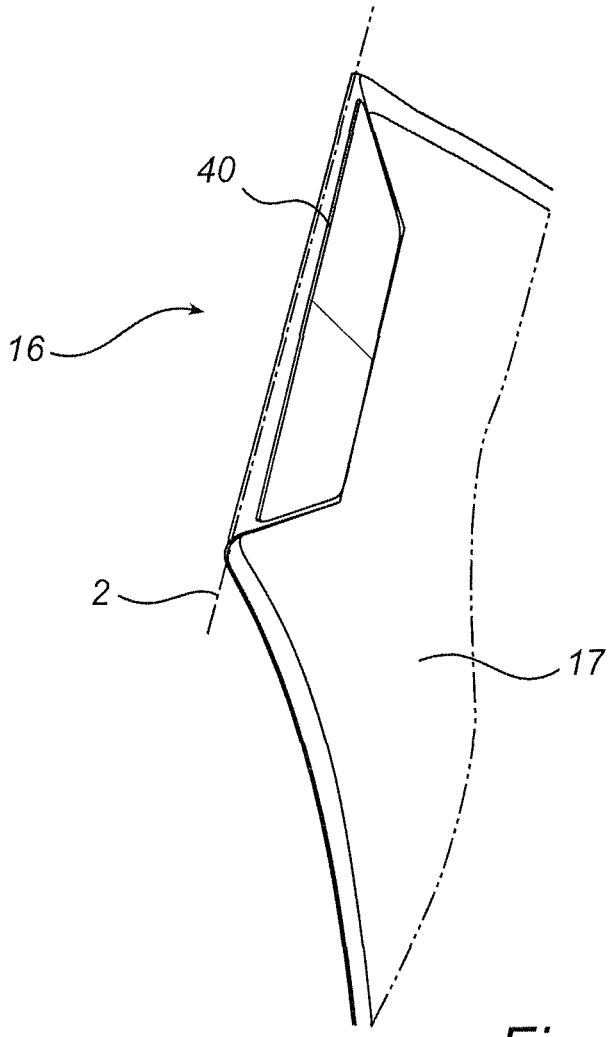
FIG. 14 shows a detached perspective view of the package shown in FIG. 12*a*-12*c*, in a resealed state.

In FIG. 14, to which reference is now made, the pouring portion of the package is illustrated in the resealed state of the package. By virtue of the fact that the second body 40 is disposed within or inside a region defined by one sub portion 10*a* of the contact surface 8 of the first body 4, it is possible to manoeuvre the first body 4 into its second position by folding about the first folding axis 2 without the second body 40 preventing the said manoeuvring. The fact that the second body 40 is smaller than the said sub portion 10*a* also implies that the second body 40 can be placed at a distance from the first folding axis 2, as can be seen from the figure. It is hereby ensured that the second body 40 does not act upon the side walls 17 when these are folded in connection with resealing of the package, which enables repeated, substantially liquid-tight resealing.

It will thus be appreciated that the present invention is not limited to the described embodiments.

For example, the above-described process for producing an opening device can be adapted such that the process also allows production of the second body of the opening device according to the above-described further embodiment.

In addition, it is conceivable to configure the inventive opening device integrally with the side walls in the opening portion of the package.

It is also conceivable to configure the package such that its geometry helps the opening device to be acted upon, when its locking members have not been activated, such that the package assumes its opened-up state. This can be realized, for example, in such a way that the opening portion is given a somewhat protruding geometry such that the package, under the influence of gravity, forms a fold which serves to separate the side walls in the opening portion. The fold will thus serve for manoeuvring of the first body into its opening position and, where appropriate, of the second body into its folded position, which corresponds to the opened-up state of the package.

Many variations and modifications of the present invention are thus possible. The scope of the invention is therefore defined solely by the appended patent claims.

The invention claimed is:

1. An opening device for a flexible package, having an opening portion which is defined by two side walls and a width, which opening device is intended to be disposed in the opening portion of the package adjacent to an opening, formed upon initial opening of the package, for opening and closing thereof, which opening device comprises:

a thin-walled first body with a contact surface and a first application surface opposite thereto for allowing application of the first body in the opening portion to a first of the two side walls, and a locking member, which first body is maneuverable, by folding about a first folding axis, between a basic position and a sealing position, in which sealing position the contact surface has sub portions directly facing each other, wherein the sub portions adjoin each other along a boundary portion which is designed to extend along substantially the full width of the opening portion, and wherein the locking member is designed for releasable locking of the body in the sealing position, and wherein the locking member is disposed in at least one of the sub portions of the contact surface and is designed to act between the sub portions in order to achieve the releasable locking.

2. The opening device according to claim 1, in which a first hinge joint, having an extent which coincides with the first folding axis, is configured in the boundary portion of the first body.

3. The opening device according to claim 2, in which the first hinge joint has a v-shaped or w-shaped cross section.

4. The opening device according to claim 1, in which the locking member forms a spacer element which mutually separates the sub portions of the contact surface in the sealing position of the first body.

5. The opening device according to claim 1, wherein the first body is maneuverable between the basic position and an opening position by folding about a second folding axis extended transversely to the first folding axis.

6. The opening device according to claim 5, in which a second hinge joint having an extent which coincides with the second folding axis is configured in the first body.

7. The opening device according to claim 5, in which the first application surface has, in the opening position of the first body, two sub portions angled relative to each other.

8. The opening device according to claim 5, further comprising a second body extended along a longitudinal axis and having a second application surface for allowing application of the second body in the opening portion to a second of the two side walls, wherein the second body is maneuverable between an unfolded position and a folded position by folding about a third folding axis, the second body being intended for maneuvering into the folded position in connection with maneuvering of the first body into its opening position.

9. The opening device according to claim 8, in which the first body has a first width and the second body has a second width, wherein the second width is less than half the first width.

10. The opening device according to claim 8, in which the first body has a first length and the second body has a second length, wherein the second length is equal to or less than the first length.

11. The opening device according to claim 8, in which a third hinge joint, having an extent which coincides with the third folding axis, is configured in the second body.

12. The opening device according to claim 1, in which the locking member is designed for point locking.

13. The opening device according to claim 1, in which the locking member is designed for linear locking.

14. The opening device according to claim 1, in which the locking member is designed for mechanical locking.

15. The opening device according to claim 1, in which the locking member is designed for mechanical locking by snap action.

16. The opening device according to claim 1, in which the locking member is designed for locking with the aid of an adhesive.

17. The opening device according to claim 1, wherein the opening device is made of a plastics material having a thickness within the range of 0.1-1mm.

18. The opening device according to claim 1, wherein the application surface is provided with an adhesive layer comprising a hot melt adhesive.

19. The opening device according to claim 18, wherein the adhesive layer covers the application surface.

20. The opening device according to claim 18, wherein the adhesive layer has an undulated surface.

21. A flexible package having an opening portion defined by two side walls, comprising:

an opening device which is disposed in the opening portion adjacent to an opening, formed upon initial opening of the package, for opening and closing thereof, the opening device comprising:

a thin-walled first body with a contact surface, a first application surface opposite thereto by which the first body is fastened to an external surface of a first of the side walls of the package, and a locking member, which first body is maneuverable, by folding about a first folding axis, between a basic position and a sealing position, in which sealing position the contact surface has sub portions directly facing each other, and which locking member is disposed in at least one of the sub portions of the contact surface and is designed to act between the sub portions in order to achieve releasable locking of the body in the sealing position, wherein the first folding axis of the first body is oriented parallel with the opening, and wherein the package is maneuverable into a resealed state in which an end section of the opening portion comprising the opening is folded about the first folding axis by maneuvering of the first body into the sealing position.

22. The flexible package according to claim 21, in which the first body of the opening device is maneuverable, by folding about a second folding axis extended transversely to the first folding axis, between the basic position and an opening position, wherein the package is maneuverable into an opened-up state in which the side walls in the opening portion are separated by maneuvering of the first body into the opening position.

23. The flexible package according to claim 22, in which the opening device further comprises a second body extended along a longitudinal axis and having a second application surface by which the second body is fastened to an external surface of a second of the two side walls, which second body is maneuverable, by folding about a third folding axis, between an unfolded position and a folded position, wherein the package is maneuverable into the opened-up state by maneuvering of the second body into the folded position in connection with maneuvering of the first body into the opening position.

24. The flexible package according to claim 23, in which the first body and the second body are disposed in the opening portion on the first side wall and second side wall respectively of the package such that the second body is situated within a region defined by the contour of one of the sub portions of the first body.

25. The flexible package according to claim 23, wherein the second folding axis of the first body is displaced in parallel with respect to the third folding axis of the second body.

* * * * *